US006643881B1

(12) United States Patent
Shim

(10) Patent No.: US 6,643,881 B1
(45) Date of Patent: Nov. 11, 2003

(54) BALL CLEANING AND POLISHING MACHINE

(76) Inventor: Sang Bae Shim, Yaksu Apt. 5-102, 216-3, Sangdo-dong, Dongjak-ku, Seoul (KR), 133-123

( * ) Notice: Subject to any disclaimer, the term of this patent is extended or adjusted under 35 U.S.C. 154(b) by 0 days.

(21) Appl. No.: 10/148,965

(22) PCT Filed: Dec. 8, 1999

(86) PCT No.: PCT/KR99/00747

§ 371 (c)(1),
(2), (4) Date: Jun. 7, 2002

(87) PCT Pub. No.: WO01/41882

PCT Pub. Date: Jun. 14, 2001

(51) Int. Cl.[7] ..... A63B 47/04

(52) U.S. Cl. ..... 15/21.2; 15/97.1; 457/85; 457/326

(58) Field of Search ..... 451/85, 326, 327, 451/328, 32, 49, 60, 446; 15/21.2, 97.1

(56) References Cited

U.S. PATENT DOCUMENTS 1,702,202 A * 2/1929 Day ..... 15/21.2
3,140,498 A * 7/1964 Drescher et al. ..... 15/97.1
3,654,655 A * 4/1972 Mitnick ..... 15/21.2
4,408,763 A * 10/1983 Simons ..... 273/286
5,524,311 A * 6/1996 Crossley ..... 15/21.2
5,546,629 A * 8/1996 Shim ..... 15/302
5,575,705 A * 11/1996 Yam et al. ..... 451/39
5,615,438 A * 4/1997 Field ..... 15/104.002
5,697,116 A * 12/1997 Loferer ..... 15/21.2
5,758,379 A * 6/1998 Hovnanian ..... 15/97.1
5,819,351 A * 10/1998 Porper ..... 15/21.2

* cited by examiner

*Primary Examiner*—George Nguyen
(74) *Attorney, Agent, or Firm*—Lowe Hauptman Gilman & Berner LLP

(57) ABSTRACT

A ball cleaning and polishing machine is provided comprising a housing, a cleaning barrel extending vertically upwards from the housing and having a cylindrical interior surface, a turntable adapted to support a plurality of game balls within the cleaning barrel and provided with a cleaning fabric remaining in contact with the game balls, an impeller coaxially mounted above the turntable for rotation relative to the turntable and for keeping the game balls isolated from one another, and an electric motor drivingly connected to the turntable for causing the turntable to rotate such that the game balls can be rubbed with the cleaning fabric. Provided on the interior surface of the cleaning barrel is a cushion lining which has a plurality of protuberances each substantially uniformly spaced apart in a circumferential direction of the lining. The machine also employs a squeezable see-through fluid container which can be replaced with a new one when the cleaning fluid runs dry.

10 Claims, 7 Drawing Sheets

BALL CLEANING AND POLISHING MACHINE

FIELD OF THE INVENTION

The present invention is directed to a ball cleaner and, more particularly, to a ball cleaning and polishing machine that has the ability to clean and polish soiled game balls, e.g., balls for the game of billiards, snooker and the like in an automated, time-effective and partial-wear-free fashion.

DESCRIPTION OF THE PRIOR ART

As a rule, billiard balls need to be cleaned as frequently as possible to wipe out chalk powders, dirts, specks and finger marks left to the surface of the billiard balls during the course of their use. This is mainly because the billiard balls with soiled or unclean surfaces are unlikely to travel straight, when struck by a cue stick, and thus fail to roll over as long a distance as the players normally expect, eventually depriving the cueist of amusement.

Manual cleaning is a traditional mode of rendering the soiled balls clean and lustrous. Stated more specifically, the billiard balls are first applied with cleaning agent one by one and then vigorously rubbed by use of a soft fabric until the surfaces thereof grow clean. It is customary for the commercialized billiard halls to provide the customers with tens or hundreds of balls at a time, which means that the number of balls to be cleaned within a given period of time would increase accordingly. The task of manually cleaning so many billiard balls on an one-by-one basis is time-consuming and highly cumbersome, as a matter of course. At a large-scale billiard hall where scores of cueists may have the games of billiards, no sufficient time would be left to make clean the used balls for the next cycle of use. This will make it unavoidable either to prepare an exceedingly great number of fresh balls beforehand or to employ clerks who should devote themselves to a ball cleaning work.

As an alternative for the traditional manual cleaning, U.K. Patent Publication No. 2189156A teaches a ball cleaning apparatus comprising a housing, the upper part of which contains a motor connected by a transmission means to a cleaning band or belt, the band or belt being arranged in the lower part of the housing in such a manner, in use, as to make frictional contact with the surfaces of a plurality of balls placed in a container disposed in the housing beneath said band or belt. The container comprises a tray provided with individual compartments for each ball. The housing contains a reservoir for a cleaning medium which is accessible from the exterior of the housing and which has a delivery means that feeds the cleaning medium to the surface of the cleaning band or belt, from which it is transferred to the balls themselves during the cleaning process.

The ball cleaning apparatus referred to just above may be said to offer a significant advantage over the conventional cleaning technique in that a plurality of balls are cleaned automatically within a short period of time. During the cleaning process, however, the balls would rotate only in a single direction by means of the cleaning belt, thus leaving certain parts of the ball surface uncleaned at all. Another drawback is that specific area of the ball surface is continually kept in frictional contact with the cleaning belt, with the result that a biased or partial abrasion takes place, adversely affecting the rolling characteristic of the balls. Insufficiency in tension of the cleaning belt may cause the cleaning belt to come out of contact with some of the balls placed on the tray such that the non-contacted balls remain dirty even after the cleaning process comes to an end. Additionally, with the ball cleaning apparatus discussed in the '156 publication, it is hard to remove residual cleaning agent from the surfaces of the cleaned balls, nor be it easy to polish the balls at the end of the cleaning process.

With these drawbacks in mind, the present inventor has developed an idle wheel type ball cleaning device which was matured into U.S. Pat. No. 5,546,629 with an issue date of Aug. 20, 1996. The ball cleaning device comprises a housing having a generally cylindrical side wall, a top access opening and a closed bottom, a turntable coaxially mounted on the spindle for rotational movement therewith, the turntable supporting the game balls, an idle wheel mounted on the turntable for rotation relative to the turntable, the idle wheel having a plurality of compartments arranged along its circumference, each of the compartments receiving the game balls in a spaced apart relationship with one another, and means for rotatably driving the spindle and the turntable in unison to subject the game balls to a rolling movement and a planetary movement around the spindle so that the idle wheel is pushed by the game balls into rotation about the spindle. Additionally, means is employed whereby the turntable and the idle wheel can be subject to an up-down movement between a lowered position where the game balls are cleaned and a raised position where the game balls are polished.

The ball cleaning device taught in the '629 patent has proven to be of bulky and heavyweight structure due mainly to the employment of the turntable up-down means. In addition, it is difficult or almost impossible to make constant the rotational speed of the idle wheel whose rotation is caused by the rotating force of the turntable indirectly applied to the idle wheel via the game balls. This means that, depending on the number and size of the balls loaded, the speed of rotation of the idle wheel may vary to a significant extent, adversely affecting the cleaning and polishing efficiency. A further disadvantage is that the cleaning fluid continues to be supplied to the game balls in an uncontrolled amount throughout the operation period of the ball cleaning device, leading to contamination and dissipation of the cleaning fluid.

In an effort to eliminate the shortcomings inherent in the '629 patent, UK Patent Publication No. 2322083A (international Publication No. WO98/35728) filed in the name of the inventor of the subject application discloses a ball cleaning and polishing device, comprising: a housing; a cleaning barrel extending vertically upwards from the housing and terminating at a top access opening; a turntable disposed inside of the cleaning barrel to support a plurality of balls and provided with a cleaning fabric; an impeller coaxially provided above the turntable and adapted to keep the balls isolated from one another; and differential drive means drivingly connected both to the turntable and the impeller for causing the turntable to rotate at a first speed and the impeller at a second speed smaller than the first speed so that the respective one of the balls can be subjected to rotation about its own axis and planetary movement about an axis of the turntable.

Employing the differential drive means in the ball cleaning device referred to above, however, would adversely affect the manufacturability and the production cost of the device as a whole. The differential drive means tends also to make the ball cleaning device structurally complicated and heavyweight.

The ball cleaning and polishing device disclosed in the UK Publication further comprises a cleaning fluid supplying means which includes a fluid reservoir received in the housing, a liquid permeable applicator pad provided on an inner surface of the cleaning barrel for making contact with the balls, a fluid dispenser provided outside of the cleaning barrel for dispensing a controlled amount of the cleaning fluid to the applicator pad, and a fluid pump for forcing the cleaning fluid to the fluid dispenser.

Mainly because the fluid reservoir taught in the UK Publication contains a large volume of the cleaning fluid to reduce the frequency of refilling the reservoir, there is a tendency for the abrasive particles dispersed in the cleaning fluid to be precipitated and solidified, which may lead to a decreased cleaning efficiency and an increased chance of malfunction of the cleaning fluid supplying means. It is very difficult, if not impossible, for the user to check out the residual amount of the cleaning fluid in order to refill the reservoir in a timely fashion. This is due to the fact the fluid reservoir, usually made of opaque material, is invisibly received in the housing of the ball cleaning device. Furtheremore, in the event that the fluid reservoir is refilled with the cleaning fluid of poor quality, the cleaning fluid supplying means may suffer premature failure and shortened service life.

SUMMARY OF THE INVENTION

It is an object of the invention to provide a ball cleaning and polishing machine which has a simplified structure and can be manufacturable in a cost-effective manner.

Another object of the invention is to provide a ball cleaning and polishing machine capable of agressively changing the direction of rotation of game balls, while subjecting the game balls to planetary movement about a machine center axis at a retarded speed.

A further object of the invention is to provide a ball cleaning and polishing machine which has the ability to supply game balls with a regulated amount of cleaning fluid in a cleaning process.

A still further object of the invention is to provide a ball cleaning and polishing machine with a squeezable see-through cleaning fluid container that permits the user to check out the residual amount of cleaning fluid and then to replace the used fluid container with a new one in a timely manner.

According to one aspect of the invention, there is provided a ball cleaning and polishing machine, comprising: a housing; a cleaning barrel extending vertically upwards from the housing and having a cylindrical interior surface; a lining provided on the interior surface of the cleaning barrel, the lining having a plurality of protuberances, each of the protuberances substantially uniformly spaced apart in a circumferential direction of the lining; a turntable adapted to support a plurality of game balls within the cleaning barrel and provided with a cleaning fabric; an impeller coaxially provided above the turntable for rotation relative to the turntable and for keeping the game balls isolated from one another; and an electric motor drivingly connected to the turntable for causing the turntable to rotate such that the game balls can be rubbed with the cleaning fabric.

According to another aspect of the invention, there is provided a ball cleaning and polishing machine, comprising: a housing; a cleaning barrel extending vertically upwards from the housing and having a cylindrical interior surface; a turntable adapted to support a plurality of game balls within the cleaning barrel and provided with a cleaning fabric; an impeller coaxially provided above the turntable for rotation relative to the turntable and for keeping the game balls isolated from one another; an electric motor drivingly connected to the turntable for causing the turntable to rotate such that the game balls can be rubbed with the cleaning fabric; and cleaning fluid supplying means including a squeezable fluid container replaceably mounted on the housing and a fluid dispenser operable to introduce the cleaning fluid from the fluid container and ejaculate a regulated amount of the cleaning fluid toward the game balls.

BRIEF DESCRIPTION OF THE DRAWINGS

The above and other objects, features, advantages of the invention will become apparent from a review of the following detailed description of the preferred embodiment taken in conjunction with the accompanying drawings, in which.

DETAILED DESCRIPTION OF THE PREFERRED EMBODIMENT

Figure 1:
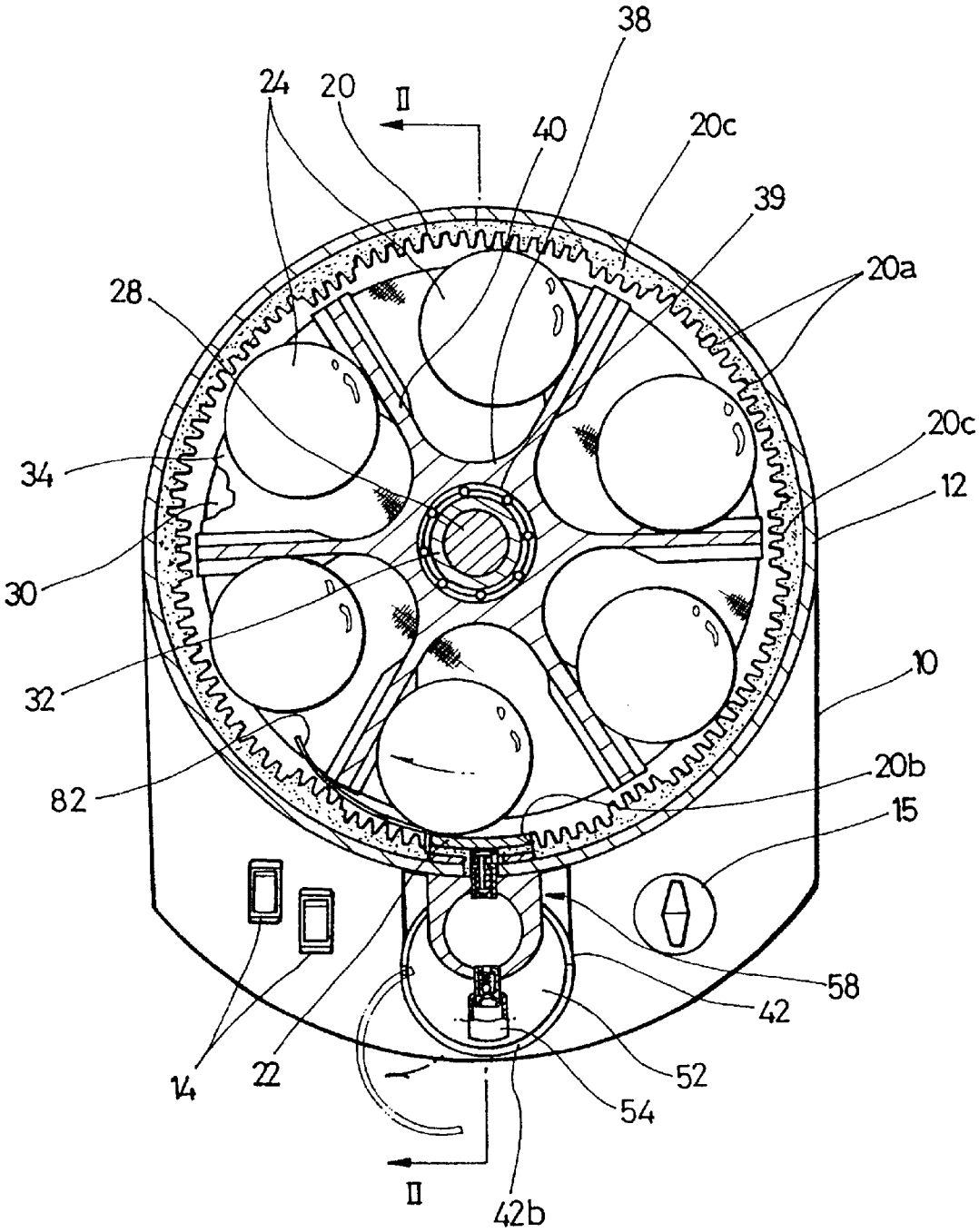
FIG. 1 is a top sectional view showing a ball cleaning and polishing machine in accordance with the invention, with six game balls loaded into a cleaning barrel.
Figure 2:
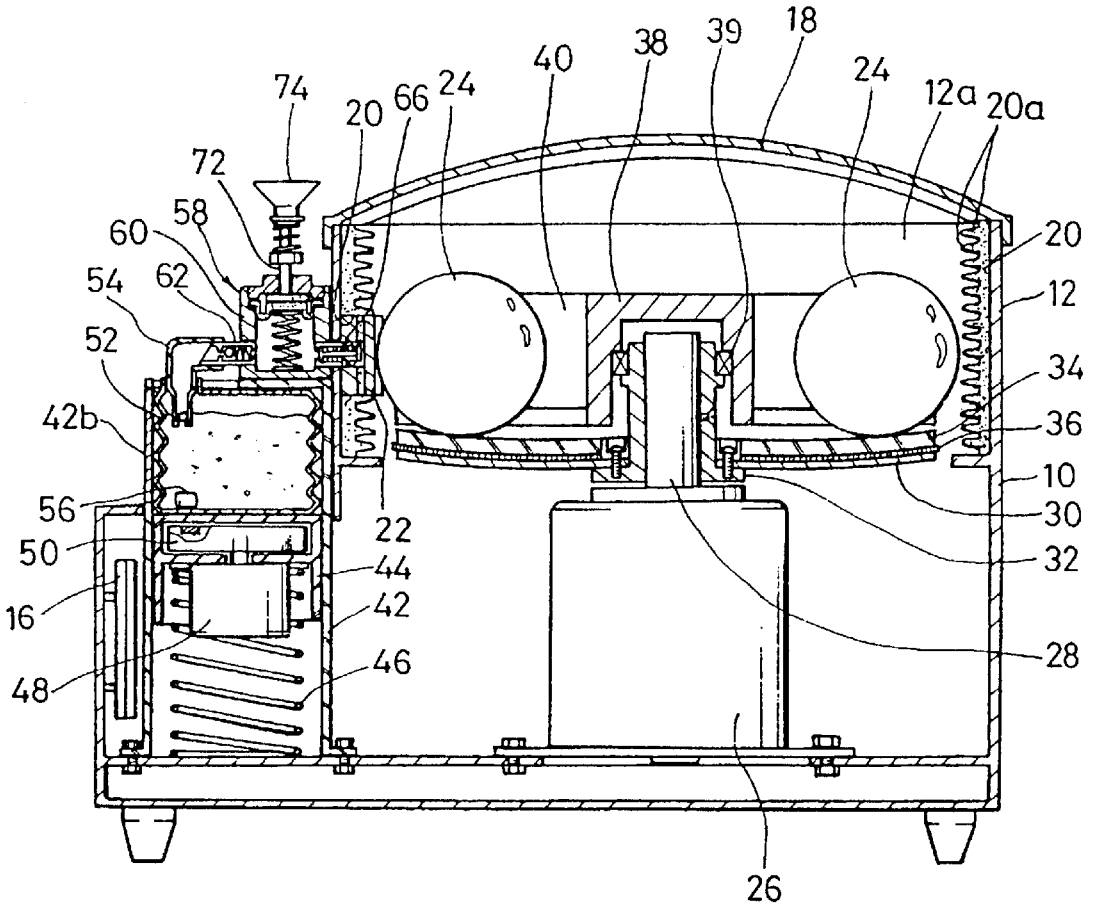
FIG. 2 is a side elevational sectional view taken along line II—II in FIG. 1, best illustrating the internal structure of the ball cleaning and polishing machine according to the present invention.

Referring first to FIGS. 1 and 2, it can be seen that a ball cleaning and polishing machine in accordance with the invention includes a housing 10 and a substantially cylindrical cleaning barrel 12 extending vertically upwards from the housing 10; On the front flat section of the housing 10, push buttons 14 and a rotary switch 15 are disposed to enable the user to operate the ball cleaning and polishing machine in a selected mode. A control board 16 is positioned just underneateh of the front flat section and serves to control the operation of an electric drive motor and an electric stirrer motor set forth later.

The cleaning barrel 12 terminates at a top access opening 12*a* which is openably closed by a lid 18. Removably fitted on the inner circumference of the cleaning barrel 12 is a shock-absorbing cushion lining 20 made of relatively soft material, e.g., rubber. The lining 20 has a multiplicity of shock absorber pins 20*a* protruding short distance radially inwardly of the cleaning barrel 12. The pins 20*a* help reduce shock and noise which may be generated in the cleaning and polishing process described in detail later. The lining 20 is provided with a cutout 20*b* that holds a liquid permeable applicator pad 22 in place. The applicator pad 22 remains soaked with cleaning fluid which contains abrasive particles and, in the cleaning process, will apply the cleaning fluid to a plurality of game balls 24 to enhance cleaning efficiency of the latter.

Figure 3:
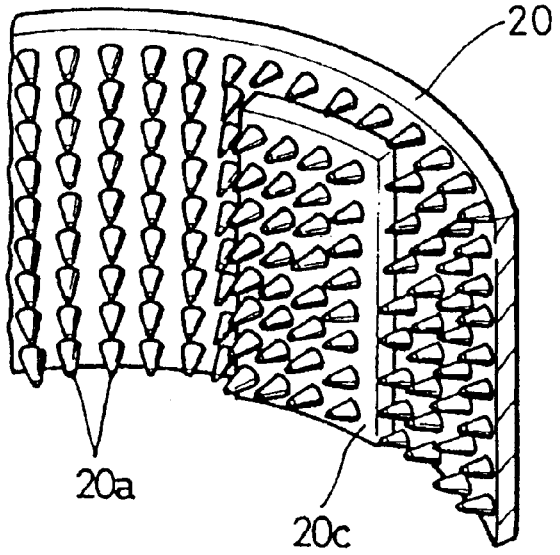
FIG. 3 is a partially cutaway enlarged perspective view showing one of the protuberances substantially uniformly spaced apart in the circumferential direction of a cushion lining.
Figure 4:
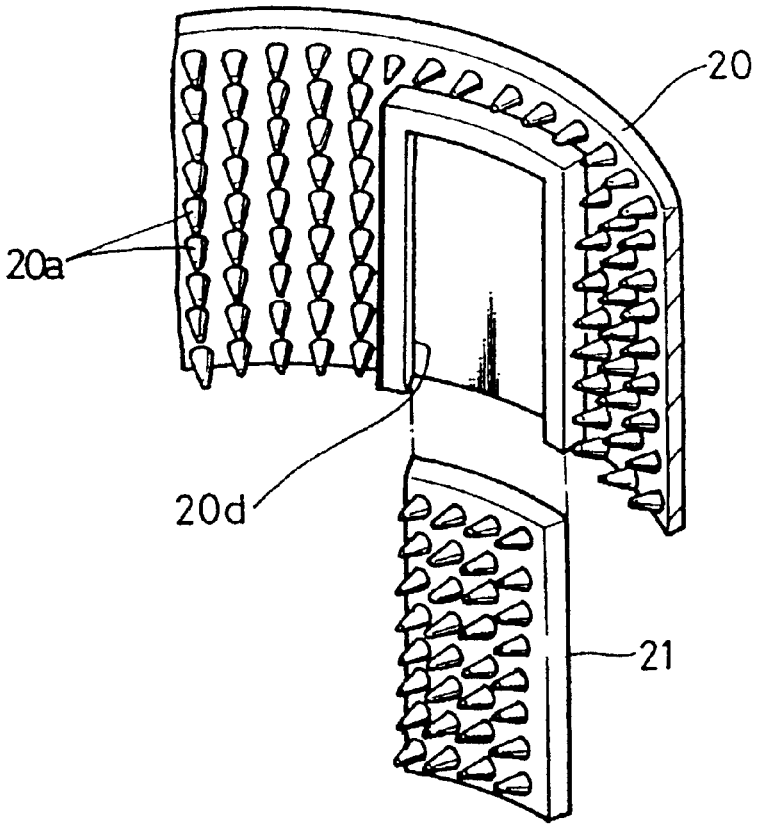
FIG. 4 shows a modified example of the protuberances, i.e., a rectangular block removably fitted through a dovetail groove of a cushion lining.

As can be seen in FIGS. 1 and 3, the cushion lining 20 has a plurality of protuberances 20*c* substantially uniformly spaced apart in a circumferential direction of the lining 20. Each of the protuberances 20*c* plays a part in repelling the game balls 24 radially inwardly as they are subjected to planetary movement about a machine center axis. Although the lining 20 is shown to have six protuberances 20*c* in the illustrated embodiment, the number of the protuberances 20*c* may be greater or lesser, if desired. A modified example of the protuberances is shown in FIG. 4 which includes a rectangular block 21 replaceably fitted into a dovetail groove 20*d* provided on the inner circumference of the cushion lining 20. Use of the rectangular block 21 makes it possible to change the size and configuration of the protuberances.

A reversible electric drive motor 26 with an output shaft 28 is mounted inside the housing 10. Around the upper extension of the output shaft 28, a turntable 30 is fixedly secured by way of a hub 32 at an elevation substantially equal to the bottom end of the cleaning barrel 12. The turntable 30 can rotate in a forward or reverse direction at the same speed as the output shaft of the electric motor 26 to impart rotational movement to the game balls supported thereon. A cleaning fabric 34 is replaceably or detachably attached to the top surface of the turntable 30 by means of, e.g., velcro fastener, such that a worn-out cleaning fabric can be replaced with a new one. The cleaning fabric 34 is preferably made of a woven cotton fabric which assures efficient cleaning of the game balls without causing any damages to the latter.

As clearly shown in FIGS. 1 and 2, an impeller 38 is rotatably supported on the hub 32 with a bearing 39 interposed therebetween so that it can freely rotate relative to the turntable 30. The impeller 38 has a plurality of, e.g., six, substantially equally spaced, radially outwardly extending blades 40 each cooperating to define ball receiving compartments therebetween, which means that the impeller 38 functions to keep the game balls isolated from one another to thereby inhibit mutual collision of the game balls in the cleaning and polishing process.

As the turntable 30 is caused to rotate in one direction, the game balls 24 supported thereon will be subjected to planetary movement about the machine center axis, in which process the game balls 24 push the blades 40 of the impeller 38 to cause the impeller 38 to rotate slowly in the same direction as the turntable.

Figure 5:
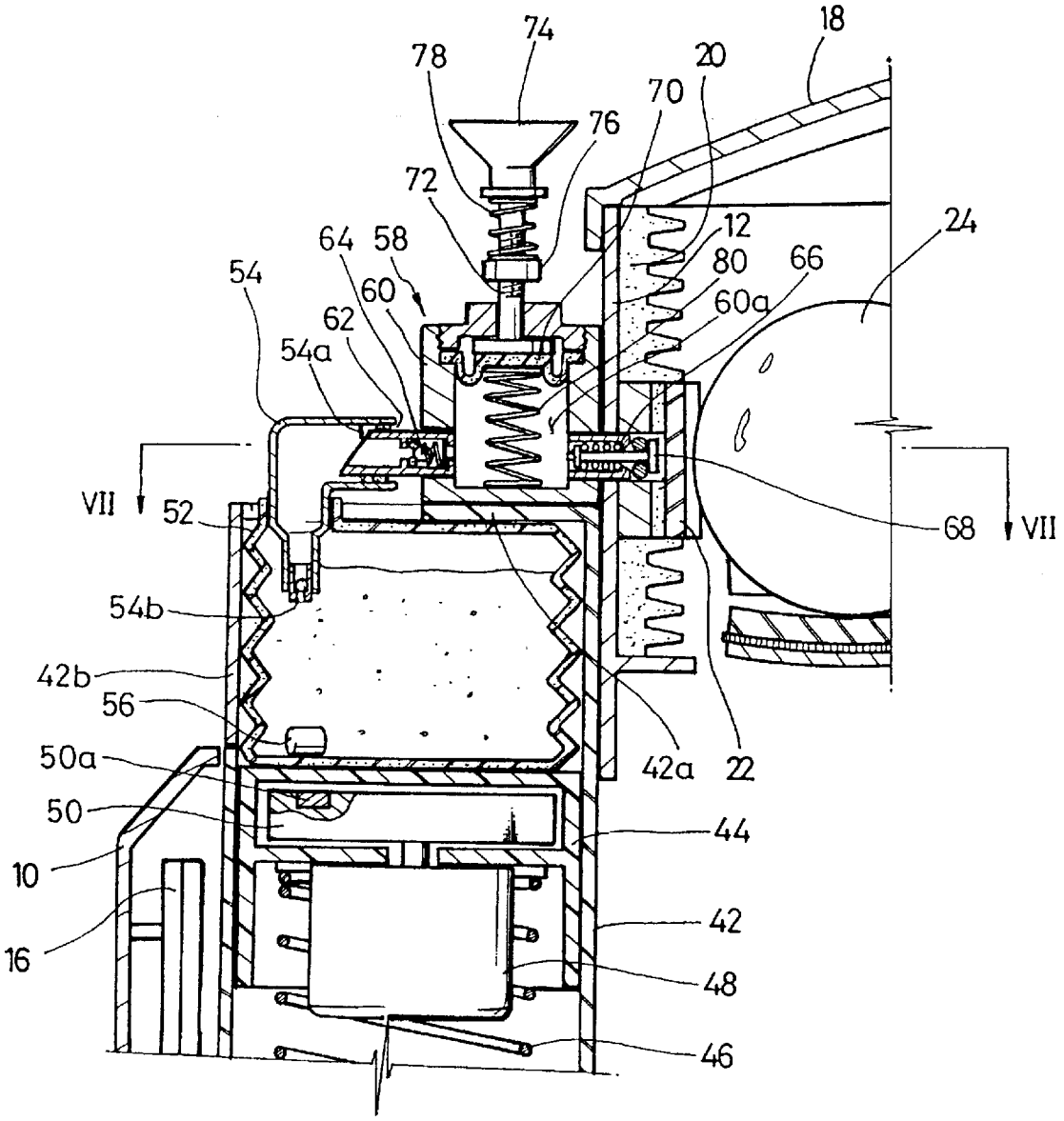
FIG. 5 illustrates a cleaning fluid supplying unit consisting of a squeezable fluid container replaceably mounted on a machine housing, a liquid permeable applicator pad attached to the inner surface of a cleaning barrel and a fluid dispenser manually operable to ejaculate a regulated amount of the cleaning fluid to the applicator pad.

Turning to FIGS. 1, 2 and 5, it can be seen that a cylindrical container casing 42 is fixedly secured to the housing 10 in front of the cleaning barrel 12. The container casing 42 has a ceiling plate 42*a* and a front door 42*b* of semi-cylindrical configuration that, when opened, allows access to the interior space of the container casing 42. Slidably received in the container casing 42 is a moving platform 44 which remains resiliently urged upwards by a compression spring 46 at all times. The moving platform 44 carries an electric stirrer motor 48 with a stirrer blade 50 having a piece of permanent magnet 50*a* attached thereto. The permanent magnet 50*a* serves to establish strong magnetic field in an upward direction, thus attracting any ferromagnetic material which lies within the magnetic field.

Replaceably located on the moving platform 44 is a squeezable see-through fluid container 52 which can be taken out of the container casing 42, if necessary, by opening the front door 42*b* as shown in phantom lines in FIG. 1. The fluid container 52 is filled with the cleaning fluid and normally compressed or squeezed against the ceiling plate 42*a* of the container casing 42 by the biasing force of the compression spring 46 applied thereto through the moving platform 44. As most clearly illustrated in FIGS. 5 and 6, the fluid container 52 is provided with a spout 54 whose external end is kept closed by a membrane 54*a* which may be pierced when in use. At the internal end of the spout 54, there is provided a refill inhibitor valve 54*b* which functions to prevent the user from refilling the fluid container 52 with the cleaning fluid of poor quality through the spout 54. Received within the fluid container 52 is a ferromagnetic metal piece 56 that would be attracted by the permanent magnet 50*a* of the stirrer blade 50 and can move together with the permanent magnet 50*a* to stir up the cleaning fluid in the fluid container 52 as the stirrer blade 50 is rotatingly driven by the electric stirrer motor 48. The fluid container 52 has to be replaced with a new one when the cleaning fluid contained therein runs dry.

Figure 6:
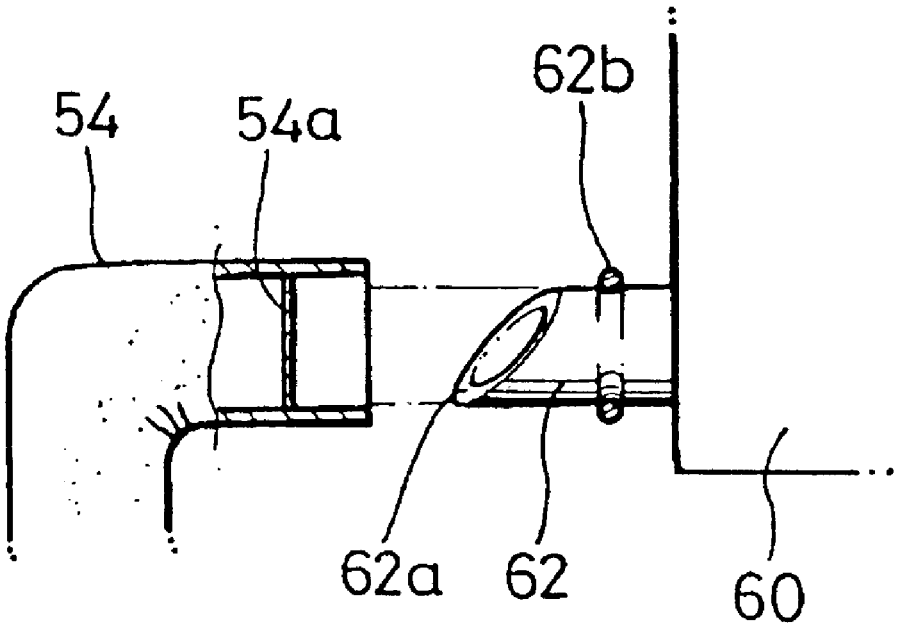
FIG. 6 shows a spout of the fluid container normally closed with a membrane and a knife-edged intake nozzle of the fluid dispenser capable of piercing through the membrane of the fluid container to allow fluid communication between the fluid container and the fluid dispenser.

In front of the cleaning barrel 12 and above the ceiling plate 42*a* of the container casing 42, there is provided a fluid dispenser 58 of the type capable of introducing the cleaning fluid from the squeezable fluid container 52 and then ejaculating a regulated amount of the cleaning fluid toward the liquid permeable applicator pad 22. The fluid dispenser 58 is provided with a hollow body 60 which has a plenum chamber 60*a* temporarily storing the cleaning fluid before it is ejaculated. A knife-edged intake nozzle 62 projects from the hollow body 60 and comes into fluid-tight engagement with the spout 54 of the fluid container 52. As best shown in FIG. 6, the intake nozzle 62 has a knife edge 62*a* for rupturing the membrane 54*a* of the spout 54 and a seal ring 62*b* for assuring leakage-free joint of the intake nozzle 62 with the spout 54. A check valve 64 is provided inside of the intake nozzle 62 and serves to prevent any backflow of the cleaning fluid from the plenum chamber 60a into the fluid container 52.

Projecting toward the applicator pad 22 from the hollow body 60 of the fluid dispenser 58 is an injector nozzle 66 which has a relief valve 68 mounted thereon. The relief valve 68 is adapted to normally keep the injector nozzle 66 closed off but will open it to ejeculate the cleaning fluid in the event that the pressure in the plenum chamber 60a exceeds a predetermined reference value. A diaphragm 70 is provided across the plenum chamber 60*a* and, at its center portion, affixed to the inner end of a push rod 72 which in turn is slidably fitted through the top of the hollow body 60 for movement between a depressed position and a released position. The push rod 72 has a knob 74 fixedly attached to the external end thereof, a stroke regulator nut 76 threadedly engaged with the middle extension of the push rod 72 and a lock spring 78 for restraining unwanted rotation of the nut 76. It becomes possible to change the stroke of the push rod 72 by way of turning the stroke regulator nut 76 in a desired direction. A return spring 80 is retained between the bottom of the hollow body 60 and the diaphragm 70 to bias the latter upwardly such that the push rod 72 can be normally maintained in the released position as indicated in FIGS. 2 and 5.

Figure 7:
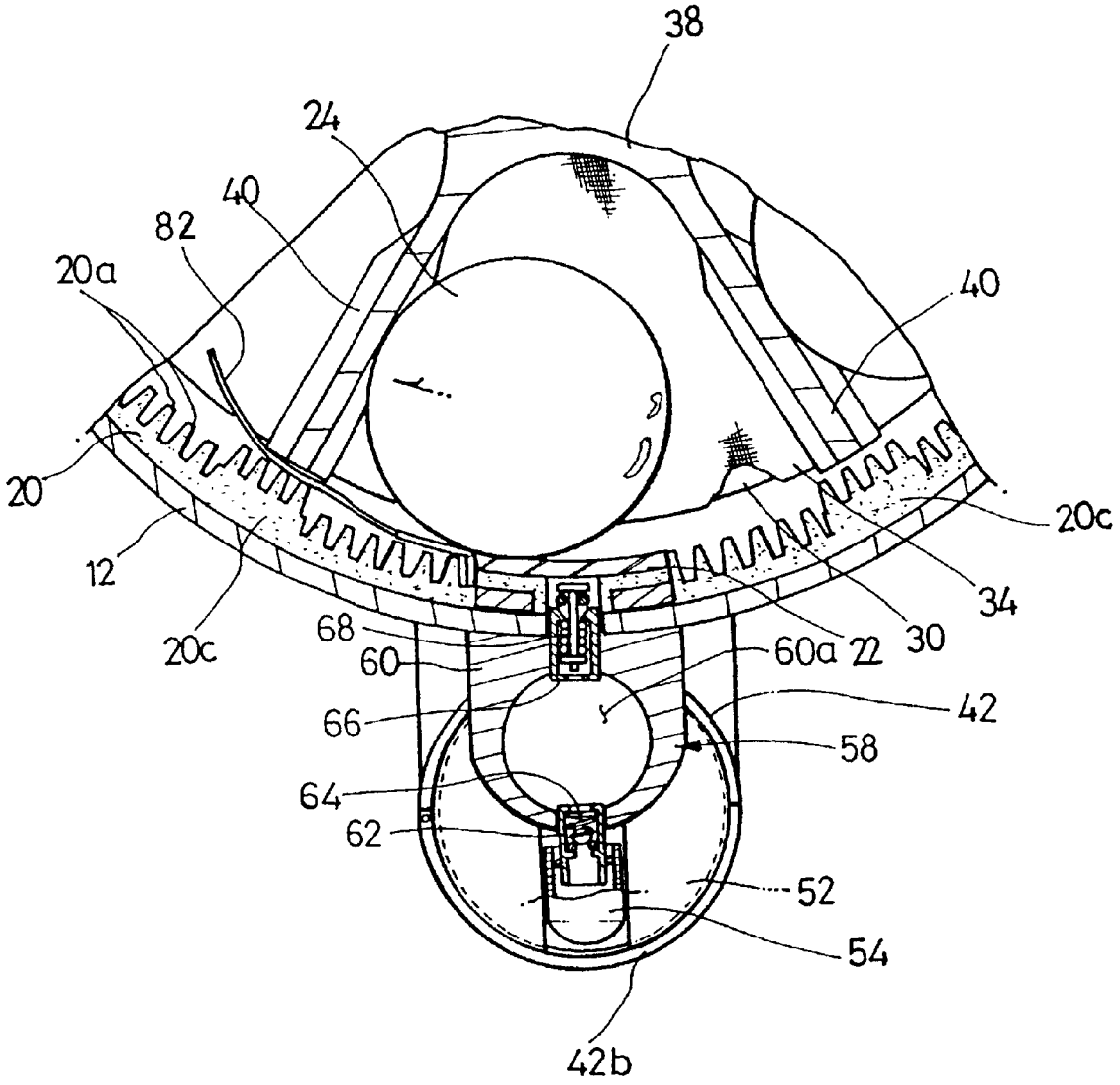
FIG. 7 is a partially enlarged sectional view taken along line VII—VII in FIG. 5, illustrating an elastically deformable flap bent into a clockwise orientation in the process of cleaning operation so that the applicator pad can apply the cleaning fluid to the moving game balls through direct contact therewith.
Figure 8:
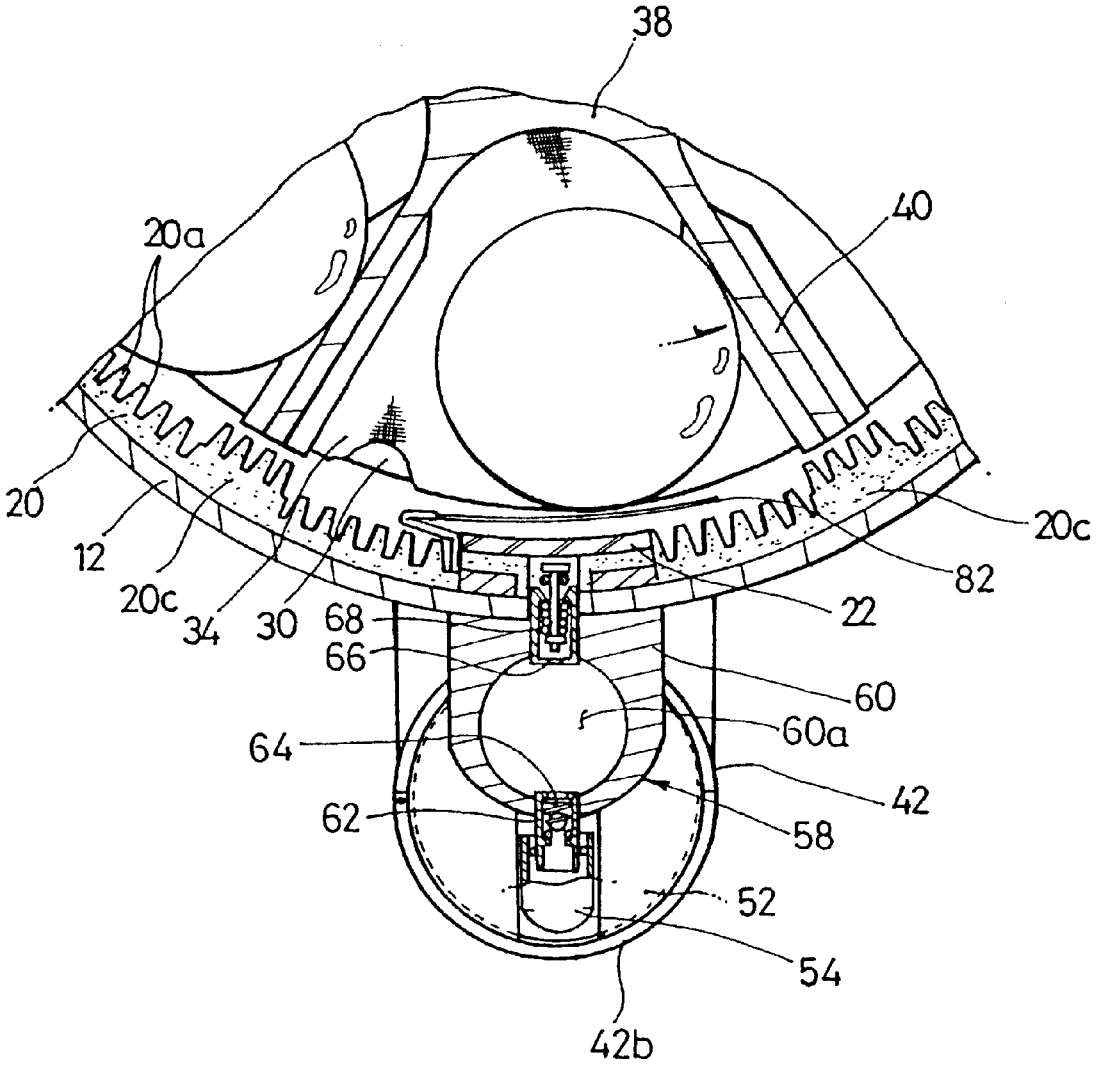
FIG. 8 is a view similar to FIG. 7 but showing the elastically deformable flap bent into a counterclockwise orientation during the polishing operation so that the applicator pad can be hidden behind the flap against any contact with the moving game balls.

Referring to FIGS. 1, 7 and 8, it is noted that an elastically pliable flap 82 is attached to one side of the liquid permeable applicator pad 22. The flap 82 can be bent clockwise to expose the applicator pad 22 to the moving game balls 24 during the time the truntable 30 and the impeller 38 are caused to rotate in a forward direction as illustrated in FIG. 7. This allows the game balls 24 to make contact with the applicator pad 22 so that the cleaning fluid can be applied to the game balls 24. In case the turntable 30 and the impeller 38 are subjected to reverse rotation, the flap 82 is bent counterclockwise as noted in FIG. 8 to hide the applicator pad 22 behind thereof. This inhibits the game balls 24 from any contact with the applicator pad 22, interrupting application of the cleaning fluid to the game balls 24.

Operation of the ball cleaning and polishing machine will be described hereinbelow with reference to FIGS. 1 through 8 of the drawings.

Under the condition that the game balls 24 to be cleaned are placed on the turntable 30 as in FIG. 1, the push buttons 14 and the rotary switch 15 are manually actuated to have the electric drive motor 26 rotate in a forward direction. As the turntable 30 is rotatingly driven by the electric motor 26, the game balls 24 are rubbed with the cleaning fabric 34 while rotating in random directions about its own axis. It is important to note that the game balls 24 is also subjected to planetary movement about the machine center axis to thereby push the blades 40 of the impeller 38, in response to which the impeller 38 begins to rotate at a speed far slower than the turntable 30.

In the course of planetary movement, the game balls 24 has a tendency to move radially outwardly by the centrifugal force and come into contact with the cushion lining 20. The game balls 24 are repulsed radially inwardly as they collide with the circumferentially disposed protuberances 20*c* of the cushion lining 20. This reduces the planetary moement speed of the game balls 24 and hence the speed of rotation of the impeller 38 which would otherwise cause the game balls 24 to uncontrollably rebound upwards and generate a great deal of operating noise. The protuberances 20*c* of the cushion lining 20 also plays a key role in irregularly changing the direction of movement of the game balls 24 to thereby have the entire surface of the game balls 24 uniformly cleaned and polished by the cleaning fabric 34.

In the meantime, the cleaning fluid in the squeezable fluid container 52 continues to be stirred by the metal piece 56 which moves together with the stirrer blade 50 of the electric stirrer motor 48. Since the fluid container 52 is normally squeezed by the compression spring 46, the cleaning fluid will be admitted into the plenum chamber 60a of the fluid dispenser 58 through the spout 54 of the fluid container 52. If the push rod 72 is manually depressed by the user at this time, the pressure in the plenum chamber 60*a* of the fluid dispenser 58 will then soar beyond a predetermined value whereby the cleaning fluid is ejaculated through the injector nozzle 66 toward the applicator pad 22.

Depending on the direction of rotation of the turntable 30 and the impeller 38, the applicator pad 22 may come into contact or out of contact with the game balls 24. Specifically, during the forward rotation of the turntable 30 and the impeller 38, the elastically pliable flap 82 is bent clockwise as shown in FIG. 7 to expose the applicator pad 22 to the game balls 24 such that the cleaning fluid is applied to the moving game balls 24 to increase the cleaning efficiency. Such a ball cleaning operation continues to be performed for a preselected period of time.

At the termination of the cleaning operation, the electric motor 26 begins to rotate in the reverse direction, whereby the turntable 30 and the impeller 38 are subjected to reverse rotation at different speeds with each other. As the turntable 30 and the impeller 38 are caused to rotate in the reverse direction, the elastically pliable flap 82 is bent counterclockwise to hide the applicator pad 22 out of contact with the game balls 24. Thus the game balls 24 is applied with no cleaning fluid and simply rubbed with the cleaning fabric 34, which is the polishing process of the game balls 24. This polishing operation continues to be carried out for a preselected period of time.

Once the entire cleaning and polishing operation comes to an end, the lid 18 is opened to take out the game balls 24 from the cleaning barrel 12 for reuse. After a long time operation of the ball cleaning and polishing device, it becomes necessary to replace the cleaning fabric 34 and the fluid container 52 with new ones.

While the invention has been described with reference to a preferred embodiment, it should be apparent to those skilled in the art that many changes and modifications may be made without departing from the scope of the invention as defined in the claims.

What is claimed is:

1. A ball cleaning and polishing machine, comprising:

a housing;

a cleaning barrel extending vertically upwards from the housing and having a cylindrical interior surface;

a lining provided on the interior surface of the cleaning barrel, the lining having a plurality of protuberances substantially uniformly spaced apart in a circumferential direction of the lining;

a turntable adapted to support a plurality of game balls within the cleaning barrel and provided with a cleaning fabric remaining in contact with the game balls;

an impeller coaxially provided above the turntable for rotation relative to the turntable and for keeping the game balls isolated from one another; and an electric motor drivingly connected to the turntable for causing the turntable to rotate such that the game balls can be rubbed with the cleaning fabric.

2. The ball cleaning and polishing machine as recited in claim 1, wherein said lining is provided with a multiplicity of shock absorber pins projecting radially inwardly from the lining.

3. The ball cleaning and polishing machine as recited in claim 1, wherein each of said protuberances is removably attached to the lining.

4. The ball cleaning and polishing machine as recited in claim 1, further comprising means for supplying cleaning fluid to the game balls.

5. The ball cleaning and polishing machine as recited in claim 4, wherein said cleaning fluid supplying means comprises a squeezable container, a liquid permeable applicator pad attached to the interior surface of said cleaning barrel for making contact with the game balls, and a fluid dispenser operable to introduce the cleaning fluid from the fluid container and ejaculate a regulated amount of the cleaning fluid to the applicator pad.

6. The ball cleaning and polishing machine as recited in claim 5, wherein said cleaning fluid supplying means further comprises stirrer means for stirring the cleaning fluid stored in the fluid container and squeezer means for normally squeezing the fluid container to cause the cleaning fluid in the fluid container to be forcedly supplied to the fluid dispenser.

7. A ball cleaning and polishing machine, comprising:

a housing;

a cleaning barrel extending vertically upwards from the housing and having a cylindrical interior surface;

a turntable adapted to support a plurality of game balls within the cleaning barrel and provided with a cleaning fabric remaining in contact with the game balls;

an impeller coaxially provided above the turntable for rotation relative to the turntable and for keeping the game balls isolated from one another;

an electric motor drivingly connected to the turntable for causing the turntable to rotate such that the game balls can be rubbed with the cleaning fabric; and cleaning fluid supplying means including a squeezable fluid container replaceably mounted on the housing and a fluid dispenser operable to introduce the cleaning fluid from the fluid container and ejaculate a regulated amount of the cleaning fluid toward the game balls.

8. The ball cleaning and polishing machine as recited in claim 7, wherein said squeezable fluid container is at least partially exposed to the outside and made of see-through material.

9. The ball cleaning and polishing machine as recited in claim 7, wherein said cleaning fluid supplying means further includes stirrer means for stirring the cleaning fluid stored in the fluid container and squeezer means for normally squeezing the fluid container to cause the cleaning fluid in the fluid container to be forcedly supplied to the fluid dispenser.

10. The ball cleaning and polishing machine as recited in claim 7, further comprising a lining provided on the interior surface of the cleaning barrel, the lining having a plurality of protuberances substantially uniformly spaced apart in a circumferential direction of the lining.

* * * * *